US006357367B1

(12) United States Patent
Breen et al.

(10) Patent No.: US 6,357,367 B1
(45) Date of Patent: Mar. 19, 2002

(54) METHOD FOR $NO_X$ REDUCTION BY UPPER FURNACE INJECTION OF BIOFUEL WATER SLURRY

(75) Inventors: Bernard P. Breen, Pittsburgh, PA (US); Jeffrey J. Sweterlitsch, Ames, IA (US); James E. Gabrielson, Hanover, MN (US)

(73) Assignee: Energy Systems Associates, Pittsburgh, PA (US)

( * ) Notice: Subject to any disclaimer, the term of this patent is extended or adjusted under 35 U.S.C. 154(b) by 0 days.

(21) Appl. No.: 09/618,782

(22) Filed: Jul. 18, 2000

(51) Int. Cl.[7] ..... F23J 11/00

(52) U.S. Cl. ..... 110/345; 110/346; 110/348; 110/342; 110/238; 422/182; 422/183

(58) Field of Search ..... 110/238, 235, 110/253, 255, 341, 342, 343, 344, 345, 346, 347, 348; 422/182, 183

(56) References Cited

U.S. PATENT DOCUMENTS

| | | | | |
|---|---|---|---|---|
| 4,501,205 A | * | 2/1985 | Funk | 110/347 |
| 4,785,746 A | | 11/1988 | Roy et al. | |
| 5,078,064 A | | 1/1992 | Breen et al. | |
| 5,131,335 A | * | 7/1992 | Spliethoff et al. | 110/345 |
| 5,746,144 A | | 5/1998 | Breen et al. | |
| 5,756,059 A | * | 5/1998 | Zamansky et al. | 423/239.1 |
| 5,915,310 A | * | 6/1999 | Hura et al. | 110/345 |
| 6,030,204 A | * | 2/2000 | Breen et al. | 431/4 |
| 6,062,848 A | * | 5/2000 | Lifshits | 431/285 |

* cited by examiner

*Primary Examiner*—Denise L. Esquivel
*Assistant Examiner*—K. B. Rinehart
(74) *Attorney, Agent, or Firm*—Buchanan Ingersoll, P.C.

(57) ABSTRACT

In an improved method for reducing nitrogen oxide emissions from a furnace wherein at least one injector is attached to the furnace above the primary combustion zone a biomass or biowaste and water slurry is injected into the flue gas through the injectors. The biowaste or a biomass material can be supplemented with a fixed nitrogen source.

28 Claims, 3 Drawing Sheets

METHOD FOR $NO_x$ REDUCTION BY UPPER FURNACE INJECTION OF BIOFUEL WATER SLURRY

FIELD OF INVENTION

The invention relates to reducing $NO_x$ emissions from furnaces by addition of a water biofuel or waste fuel slurry to the furnace outside the primary combustion zone.

BACKGROUND OF THE INVENTION

During combustion of fuels with fixed nitrogen such as coal, oxygen from the air may combine with the nitrogen to produce nitrogen oxides ($NO_x$). At sufficiently high temperatures, oxygen reacts directly with atmospheric nitrogen to form $NO_x$. Emission of nitrogen oxide is regarded as undesirable because the presence of nitrogen oxide in a furnace flue gas (along with sulfur dioxides) causes the condensed gases to become corrosive and acidic. There are numerous government regulations which limit the amount of nitrogen oxide which may be emitted from a combustion furnace. Titles I and IV of the Clean Air Act as amended in 1990 ("The Clean Air Act") require significant $NO_x$ reduction from large power plants. Title I of the Clean Air Act focuses on the problems of ozone non-attainment. Ozone is formed as a result of photochemical reactions between nitrogen oxides emitted from central power generating stations, vehicles and other stationary sources, and volatile organic compounds. Ozone is harmful to human health. Consequently, in many urban areas the Title I $NO_x$. controls are more stringent than the Title IV limits. Thus, there is a need for apparatus and processes which reduce the nitrogen oxide emissions in furnace flue gas.

Commercially available techniques to reduce the nitrogen oxide emissions in a furnace flue gas are low $NO_x$ burners, overfire air, selective non-catalytic $NO_x$ reduction (SNCR), selective catalytic reduction (SCR), and reburning. Currently, retrofitting boilers with low $NO_x$ burners and overfire air is the most economic route to comply with Title IV requirements of the Clean Air Act. However, low $NO_x$ burners cannot reduce $NO_x$ emissions to levels required by Title I of the Clean Air Act. As a consequence, electric utilities are faced with the option of adding SNCR or reburning to the boiler. In addition, cyclone boilers cannot be retrofitted with low $NO_x$ burners. SCR, SNCR and reburning are the options for cyclone boilers.

The reburning process is also known as in-furnace nitrogen oxide reduction or fuel staging. The standard reburning process has been described in several patents and publications. See for example, "Enhancing the Use of Coals by Gas Reburning -Sorbent Injection," submitted at the Energy and Environmental Research Corporation (EERC), First Industry Panel Meeting, Pittsburgh, Pa., Mar. 15, 1988; "GR-SI Process Design Studies for Hennepin Unit #1—Project Review," Energy and Environmental research Corporation (EERC), submitted at the Project Review Meeting on Jun. 15–16, 1988; "Reduction of Sulfur Trioxide and Nitrogen Oxides by Secondary Fuel Injection," Wendt, et al.; published at the Symposium of the Combustion Institute, 1972; "Mitsubishi 'MACT' In-Furnace $NO_x$ Removal Process for Steam Generator," Sakai, et al.; published at the U.S.—Japan $NO_x$ Information Exchange, Tokyo, Japan, May 25–30, 1981. In reburning a fraction of the total thermal input is injected above the primary flame zone in the form of a hydrocarbon fuel such as coal, oil, or gas. A reburn zone stoichiometry of 0.90 (10% excess fuel) is considered optimum for $NO_x$ control. Thus, the amount of reburn fuel required is a direct function of the primary zone excess air. Under typical boiler conditions a reburn fuel input in the range of 15% to 25% is sufficient to form a fuel-rich reburn zone. The reburn fuel is injected at high temperatures in order to promote reactions under the overall fuel rich stoichiometry. Typical flue gas temperatures at the injection location are above 2600° F. Completion air is added above the fuel rich reburn zone in order to burn off the unburnt hydrocarbons and carbon monoxide (CO). In addition to the above specifications, the prior art on standard reburn teaches that rapid and complete dispersion of the reburn fuel in flue gas is beneficial. Thus, flue gas recirculation (FGR) has been used to promote mixing in all standard reburn demonstrations. Standard reburn technology requires a tall furnace to set up a fuel rich zone followed by a lean zone. Many furnaces do not have the volumes required for retrofitting this technology.

In current practice of the reburning process, usually more than enough fuel is added to react with all of the oxygen remaining in the original combustion products. A reducing zone, or a zone with an excess of fuel is formed. In this reducing zone the NO reacts with the excess fuel to form $N_2$, $NH_3$, HCN, and other reduced nitrogen. Then more air is added to combust the remainder of the reburn fuel. At this point the $NH_3$, HCN, and other reduced forms are oxidized to $N_2$ and NO. At this step and throughout the mixing process there is also a direct reaction between NO and $NH_3$ to form $N_2$. In each step part of the fixed nitrogen (originally NO) was converted to $N_2$. This is the goal of the reburn process.

Sometimes a $NO_x$. reduction process is used in which the upper furnace fuel is not added in sufficient qualities to consume all of the oxygen remaining in the gas after the initial combustion. In such a process it is necessary that large volumes become reducing while parallel volumes remain oxidizing. In the reducing volumes $N_2$, $NH_3$, and HCN are formed. Then the reducing and oxidizing gases mix together and the remainder of the fuel is consumed. At this point the reduced nitrogen species are oxidized to $N_2$ and NO. Again there is direct reduction to $N_2$ by the reaction between $NH_3$ and NO.

The process which is sometimes called controlled fuel lean reburn usually requires natural gas as the upper furnace fuel. Natural gas is expensive. Penetration and mixing is a great problem. Utility boiler furnaces have horizontal dimensions of 50 feet and greater. The carrier gas may be steam, air, or recycled combustion products. Often it is necessary to use a carrier gas to assure adequate penetration of the natural gas into the furnace. If the upper furnace natural gas is 5% of the fuel and the fuel is only 10% of the air flow, upper furnace injected natural gas is perhaps only 0.5% of the gas flow. The combustion products being quite hot may have a volume as high as 1000 times the upper furnace natural gas. Use of steam as a carrier gas is expensive. The use of air or recycled combustion products requires expensive duct work. Often there is no place for the duct work. The boiler face is simply too crowded with necessary equipment to allow the duct work to be installed. Large penetrations through the furnace walls are needed and this requires bending water wall tubes. The flue gas needs to be returned from a remote part of the boiler. Fans are needed for flue gas and often for air. Because air has oxygen in it, use of air as the carrier gas requires more upper furnace fuel before the gas stream can be made reducing.

Some operators have tried coal as a reburn fuel. The burnout times for coal are longer than for natural gas. This requires that both the fuel and the burnout air be added sooner. As a result, much of the reaction occurs at higher temperatures which results in more $NO_x$ emissions. The use of coal requires that there be additional pipes to carry primary air and pulverized fuel from the mills usually at ground level to the height where the reburn fuel is injected. It may even require an additional pulverizer.

A method of reducing $NO_x$ by injecting: a coal water slurry as a fuel lean reburn fuel has been patented, as U.S. Pat. No. 5,746,144, and that invention overcomes many of the objections to reburning with coal. Yet, this fuel requires longer burnout times than natural gas. Hence, there is still a need for a reburn fuel which has the benefits of a coal water slurry while also having a shorter burnout time.

SUMMARY OF THE INVENTION

We provide a method of reducing $NO_x$ emissions by injecting a biowaste water slurry, a biomass water slurry, waste rubber water slurry, waste plastic water slurry, orremulsion, or a wood water slurry into the upper furnace forming a fuel lean reburn process. Preferably the slurry is injected into a region of the furnace which is 1800° F. to 2700° F.

We also prefer to add sufficient water in the slurry to drive the reaction between water and carbon monoxide to the products to the hydrogen and carbon dioxide.

We also prefer to add a calcium compound to the fuel slurry. The calcium reacts with the sulfur dioxide to form calcium sulfate and thus reduce the emissions of sulfur dioxide.

We further prefer to introduce our slurry into the furnace through a combination of atomizing nozzles and jets.

We may also add ammonia, urea or other fixed nitrogen compound to the fuel water slurry as a selective reducing agent to reduce NO.

We may add animal wastes to increase the nitrogen in the reburn slurry.

We may also use a catalyst to improve the reaction between the reduced fixed nitrogen and nitrogen oxides.

Other objects and advantages of the invention will become apparent from a description of certain preferred embodiments described with reference to the figures.

DESCRIPTION OF THE PREFERRED EMBODIMENTS

Coal or other fuel, usually a solid fuel is burned in a furnace or a boiler. Most of the coal is pulverized to about 60% to 80% through a 200 mesh screen. It is conveyed to the furnace in about 15% to 25% of the combustion air. It then flows through burners that also introduce most or all of the balance of the combustion air, usually with an excess in air of 10% to 35%. At times, for partial control of $NO_x$ emissions, some of the combustion air is introduced through alternate openings such as overfire air ports. After issuing from the burners, the coal burns and releases heat, much of which may be absorbed into water flowing in tubes which form the enclosure of the furnace.

Coal usually contains about one percent fixed nitrogen. During the combustion process 15% to 35% of this fixed nitrogen is converted to NO. In addition, a very small fraction of the nitrogen in the combustion air is converted to NO. Our process is designed to convert much of this NO to the harmless $N_2$.

To reduce the NO we inject a slurry of fuel in water into the furnace above the top row of burners. We design our process to allow the fuel to react with the oxygen in the combustion products and to burn out almost completely. We place the fuel water slurry so the CO which is present near the end of the combustion product will react with water from the slurry and from combustion to form $CO_2$ and $H_2$. The $H_2$ burns more easily at the falling temperatures near the furnace exit and it facilitates the reaction between reduced nitrogen species and NO to form $N_2$ and thus reduce $NO_x$ emissions. The $H_2$ enhances the NO destroying reactions whether the reduced nitrogen comes from fuel in the slurry, from reactions between the fuel in the slurry and previously formed NO, or from ammonia or urea added to the slurry or introduced later. At the same time we introduced water fuel slurry so the nitrogen reactions will be at the lowest possible temperature which will allow the lowest emissions.

The $H_2$ opens up the window of the NO destroying reactions. It especially extends the temperature window to lower temperatures. It is fortunate that this is true, since the equilibrium between CO with $H_2O$ and $CO_2$ with $H_2$ favors the $H_2$ side at lower temperature. For the reaction:

$$CO+H_2O=CO_2+H_2$$

with half as much $H_2O$ as $CO_2$ which would be typical of our process, especially near the fuel-slurry stream, the equilibrium ratios at the temperatures shown are as follows.

| Temperature, ° F. | CO | $H_2$ |
|---|---|---|
| 2420 | 1 | 0.158 |
| 2000 | 1 | 0.223 |
| 1700 | 1 | 0.35 |
| 1520 | 1 | 0.5 |

From this it can be that at the lower temperatures where it is necessary to reduce the NO, the $H_2$ concentration will be increased and the $H_2$ will be assisting the reaction.

Figure 1:
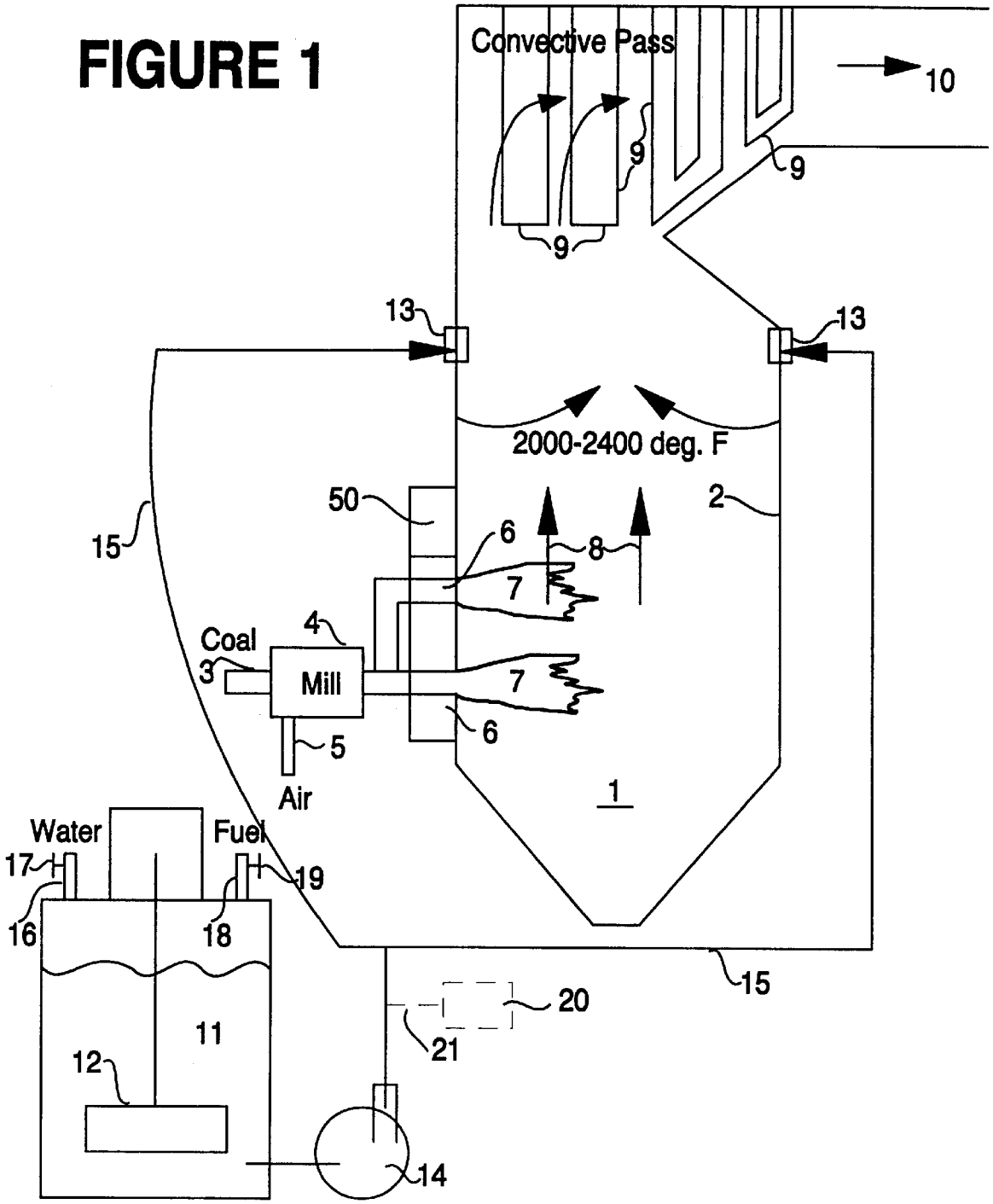
FIG. 1 is a diagram of a furnace in which a waste or biofuel water slurry is being injected in accordance with the present invention.

Our fuel water slurry can be injected into a wide variety of furnaces for $NO_x$ reduction. The furnace could be a boiler, a process heater, an incinerator, or a type of furnace which directly or indirectly supplies hot gases to heat materials in process. The furnace 1 shown in FIG. 1 is designed to burn coal which passes from a supply pipe 3 into mill 4. The coal is milled and combined with air from primary air supply 5 and directed to burners 6. At the burners the coal is ignited forming flames in the primary combustion zone. In the primary combustion zone the temperature is typically above 3,000° F. In the furnace shown here some of the air is introduced through overfire air ports 5 which causes the primary flame zones 7 to be fuel rich and reduces the $NO_x$ emissions. Combustion products flow from the primary combustion zone in the direction of arrows 8 to heat exchangers 9 in the upper convection zone of the furnace. The flue gas is directed through the conduit 10 to an economizer and other energy recovery devices and then to an exhaust stack (not shown). At some distance above the primary combustion zone there is a region where the flue gas is in the range of 2,000° to 2,400° F. At that region we prefer to provide injectors 13 in furnace wall 2. Even with the low $NO_x$ operation provided with the overfire air system, our fuel water slurry improvement reduces the $NO_x$ even further. The lower the slurry is introduced, the more penetration will be possible and necessary. If the slurry is put in just before the convection pass, it will be necessary to have both good atomization and maximum penetration which are mutually exclusive. Lower injection or multiple elevation injection with some of the injection as jets is preferred. We provide a slurry tank 11 containing a mixer 12. Fuel water slurry is drawn from the slurry tank by pump 14 through the slurry pipes 15 to injectors 13. Valve 17 on the water supply 16 and valve 19 on the fuel supply pipe 18 enable us to adjust the fuel water ratio in the slurry. An optional supply 20 is connected to slurry pipe 15. Through this supply we can introduce lime, limestone, ammonia, a second source of combustible matter, or urea into the fuel water slurry.

As the gases progress through the convective passes of a boiler, the temperatures drop very rapidly from about 2000° F. to about 400° F. That is they fall very rapidly through the temperature window where the reduced fixed nitrogen reacts with the nitrogen oxides. Normally this temperature window is only about 100 degrees wide and even when we increase it by producing $H_2$ it is no more than 400 degrees wide. So, to utilize reduced fixed nitrogen which may pass through this window along with $NO_x$, we will at times put in a catalyst which is selective for $NO_x$ reduction by $NH_3$. This catalyst will further reduce the $NO_x$ emissions.

The water in the slurry will reduce even further the combustion temperature which will improve the $NO_x$ removal. The water improves the burn out of any char formed from the combustion by the reaction between solid carbon and water to form carbon monoxide and hydrogen. This reaction is endothermic, however, and there must also be reaction of the carbon with oxygen to maintain the temperature of the char. This water also improves the kinetics of the oxidation of CO which allows the process to operate at lower temperatures. The ratio of water to fuel can be changed to further modify the very local temperatures of the upper furnace combustion. If the temperature is a bit too high for the lowest $NO_x$, for $CaCO_3$ calcination, or for effective use of urea, more water can be added. Fuel/water ratio changes can be made for final temperature trim and to adjust the location of the burn out of the fuel in the slurry.

The upper furnace location of the injection and the cooling of the ensuing flames by the presence of the water provides a low temperature environment which is conducive to burning limestone to lime in a manner that causes the lime to be reactive. Limestone ($CaCO_3$) is sometimes injected directly into furnaces where it is calcined to lime (CaO), which subsequently reacts with the sulfur dioxide ($SO_2$) and oxygen in the gas to form calcium sulfate ($CaSO_4$) and thus the $SO_2$ emissions are reduced. Temperatures of 2000° to 2400° F. are needed to calcine limestone in the short time available in the furnace. Yet, temperatures as low as 2600° F. can dead burn the lime. When the lime is dead burned, it has less surface area and it only poorly reacts with the $SO_2$. Thus, by adding limestone to our fuel water slurry where we control the reaction temperature, we are able to effectively calcine the limestone without dead burning the resulting lime. Therefore, we produce a reactive product. This reactive lime is in the correct place to remove the $SO_2$ from the flue gas.

Figure 2:
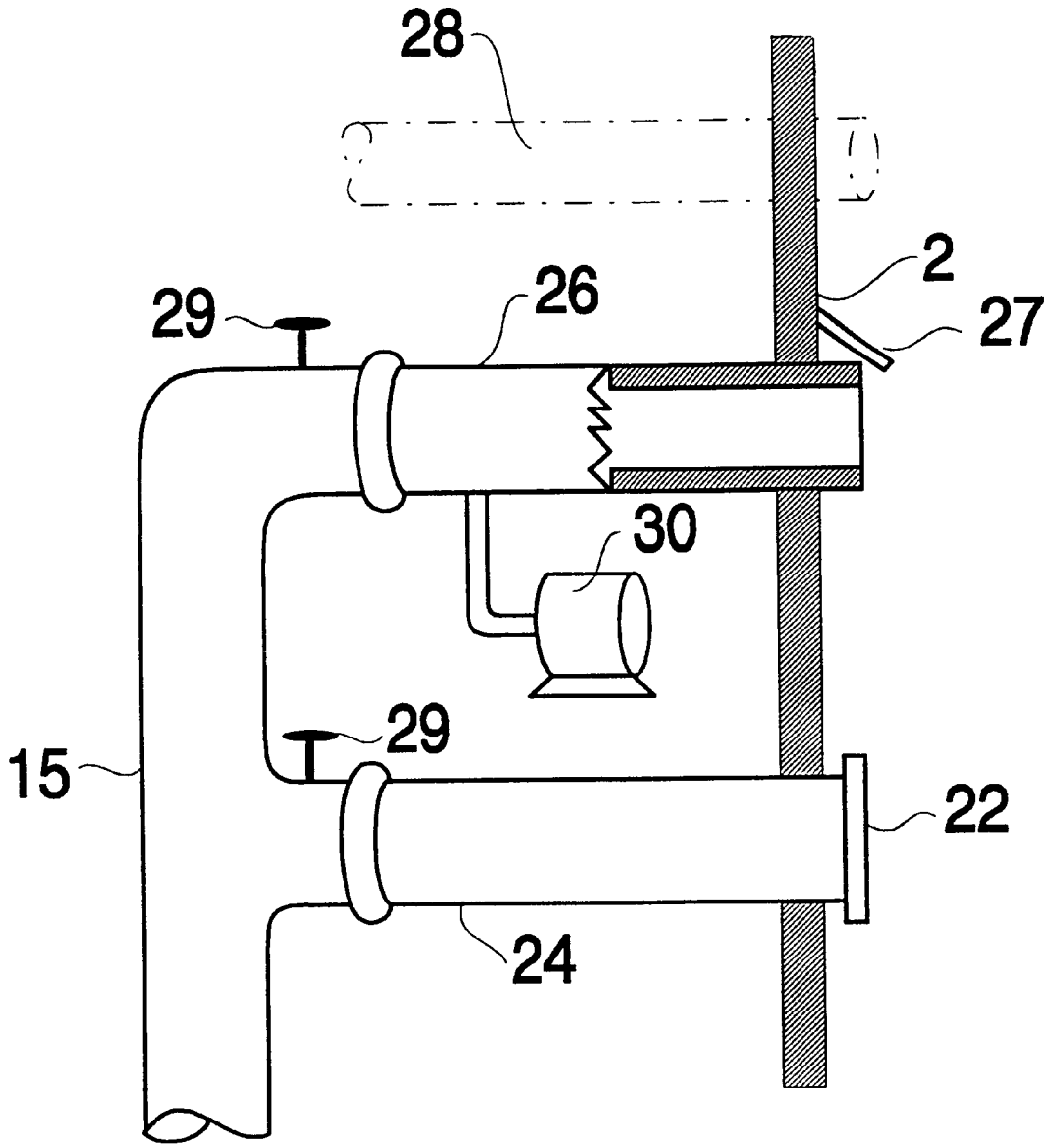
FIG. 2 is a side view partially in section of a present preferred injector combination for injecting the fuel water slurry.

As shown in FIG. 2, we prefer to introduce the fuel water slurry through atomizing nozzles 22 which can handle the slurry and are connected to injector pipe 24 and through open jets 26 which introduce a continuous stream for maximum penetration. Although only one atomizing nozzle and one jet are shown in FIG. 2, several such pairs are positioned around the furnace. Different size jets and atomized drops can be used depending upon the requirements of the specific furnace. Control valves 109 allow us to turn injectors on and off. Consequently, we can select elevations within the furnace where injectors are functioning and thereby control burn out of fuel particles. A pump 30 connected to at least some of the injectors for injecting additional water, air or nitrogen into the slurry helps us to control the velocity of the slurry stream and resulting penetration. We wish to cover the total furnace area with fuel water slurry in the cases where we use burn out air. If desired, completion air can be introduced near jets 22 and 26 through optional completion air pipe 28 shown in chainline in FIG. 2. An igniter 27 may also be provided at all or some of the jets or nozzles. In the case where no burn out air is used, we wish to cover the volumes to be made reducing very completely without mixing any of the slurry into the part which is to remain oxidizing.

Figure 3:
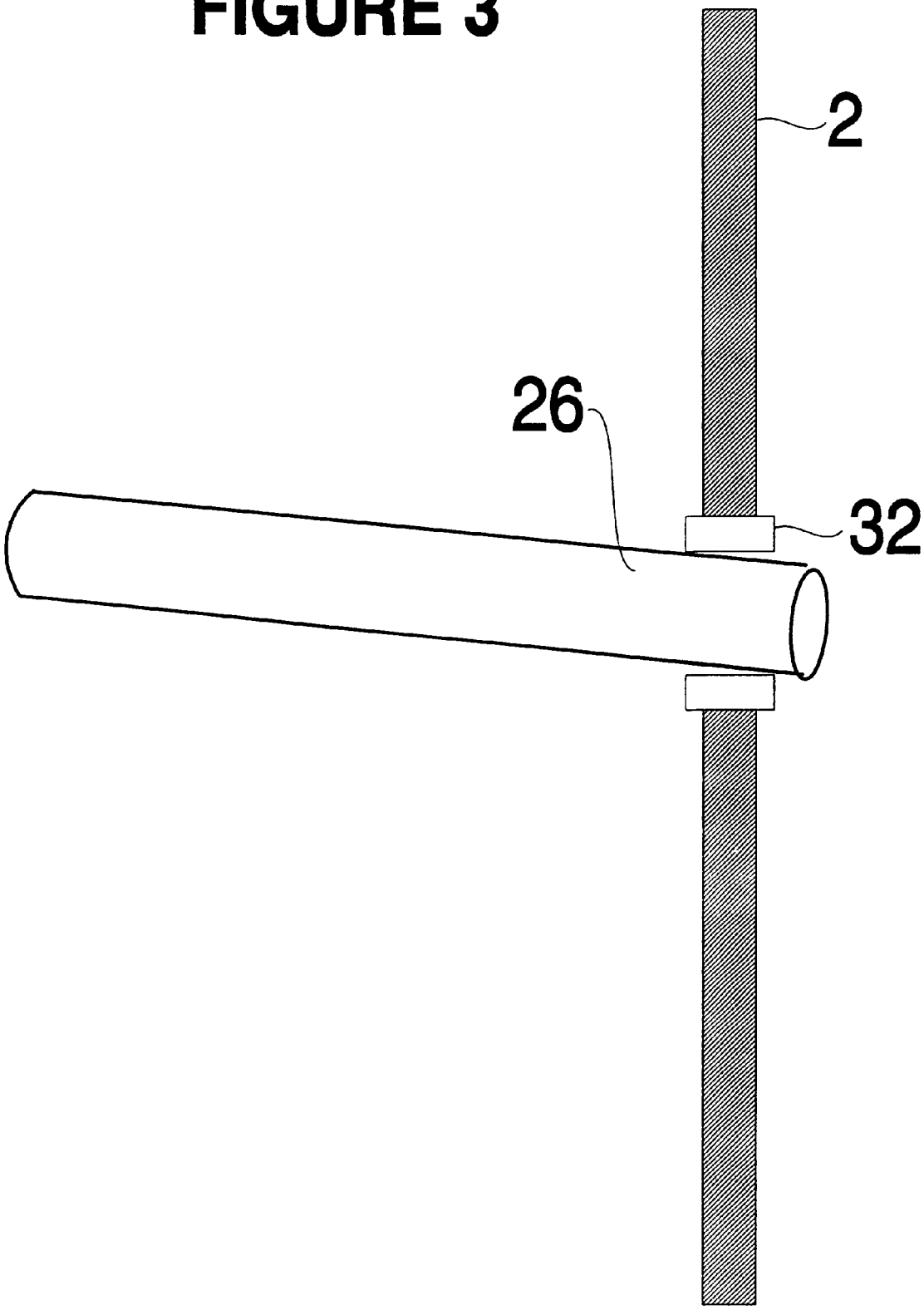
FIG. 3 is a side view of an adjustable injector for injecting the biofuel or waste fuel water slurry.

As shown in FIG. 3, we prefer to provide a coupling 32 for at least some of the injector pipes 26 which allows us to change the direction of the flow of the slurry into the furnace. This permits the operator to adjust the injectors to assure that the entire area of the furnace receives the slurry.

In the case where no burn out air is used and a face fired or opposed fired unit is being used, it is best to establish alternate lanes of reducing mixtures, by fuel water slurry injection and oxidizing lanes. The relative width of the lanes would depend upon the amount of oxygen in the initial combustion products, the final amount of oxygen, and how much surplus fuel is to be in the reducing lanes. The absolute widths will be sufficient to allow almost complete volatilization and combustion of the fuel in the reducing region.

In a tangentially fired boiler it is best to introduce streams of slurry one above the other in each corner of the furnace. Atomized streams may be introduced with the jets to assure complete coverage. The coverage zones are from 4 to 12 feet high. It is not always necessary to introduce the slurry at every corner. The same general arrangement of fuel water slurry injection would be used with and without completion air. It is also true that the same general arrangement would be used with and without an overfire air system.

Gas from cyclone furnaces can be treated in the furnace after the gas has exited the cyclones. A lane type arrangement is best unless completion air is used.

While the $NO_x$ which is removed from flue gas by reburn is often seen as the reduction of NO to $N_2$ by fuel or the reaction of $NH_3$ or HCN to $N_2$ by partial oxidation, some of the removal is the result of NO reacting with $NH_3$ or HCN to form $N_2$. The $NH_3$ or HCN usually is formed from NO by reduction by fuel. The reaction eliminates two fixed nitrogen atoms. This is very useful. Sometimes a reduced nitrogen will be added to react with NO. This is the case in the well known selective non-catalytic reduction of $NO_x$ (SNCR) which ammonia ($NH_3$) or urea is injected in the gas at about 1800° F. The reagent reacts with the NO to form $N_2$. In some cases, ammonia is added with natural gas to amplify the $NO_x$ reduction of a controlled mixing upper furnace fuel injection process.

We recognize that the many solid and liquid fuels have fixed nitrogen in them and that as the fuel is combusted in the reducing eddies in the upper furnace some of the nitrogen liberated from the slurry fuel will react with NO to form $N_2$. This will be more predominant if most of the upper furnace coal is burned with less than the stoichiometric air for complete combustion. Since the total NO, both thermal $NO_x$ and fuel bound nitrogen $NO_x$ will be only 10% to 30% of the nitrogen in the primary fuel, a small amount of reburn fuel could supply enough fixed nitrogen to eliminate most of the NO by this mechanism alone. However, this nitrogen is not very effective at reducing $NO_x$. at the temperatures in the upper furnace. These temperatures are too high for best use of $NH_3$ or urea to reduce NO.

To overcome this problem, some more reduced nitrogen can be added to the fuel water slurry. Urea or ammonia can be added to the fuel water slurry to act as a selective reducing agent to reduce NO. The temperature is high enough that we need not worry about slip. The $NH_3$ or urea that does not react with the NO will be decomposed. At the same time, the reducing conditions will keep the decomposing $NH_3$ or urea from forming NO. Both urea and ammonia are readily soluble in water and can easily be added to the slurry and in amounts beyond the stoichiometric ratio with the NO. The excess will form $N_2$ in the reducing conditions at these temperatures, which are several hundred degrees above the optimum SNCR temperature.

Biomass is any material that once was alive, typically plant material, and biowaste is the waste material excreted by animals. Biowaste and biomass will have some fixed nitrogen in them. This may range from 0.4% for various straws to 3% for legume hays. Animal wastes, especially urine may have high nitrogen to combustible matter ratios. For best performance of the reburn process we need 0.4% to 2.0% nitrogen on moisture and ash free basis in the fuel water slurry. Waste rubber, plastic, and wood slurries will perform better if biomass with high nitrogen or animal waste is mixed into the slurry. Certain straws, grasses and other biomass materials will perform better if they are mixed with wastes containing higher levels of nitrogen. Urea or ammonia can be substituted for the nitrogen containing biomaterials.

The water in the slurry will increase the acid dewpoint of the flue gas and cause more $SO_3$ to condense on the flyash as sulfuric acid. The result will be a better performing electrostatic precipitator. The water in the slurry, beside providing for penetration, also aids fuel combustion through the well known coal-water gasification reaction.

In general, it is better to operate upper furnace fuel injection at temperatures which are as low as possible. This increases the $NO_x$ reduction potential directly in proportion to the decrease in equilibrium $NO_x$. as the temperature decreases. However, in the case of fuel water slurry where the fuel is very economical it is possible to overcome this temperature limitation by using upper furnace fuel. If completion air is used, it is necessary to use a great amount of completion air if a great amount of fuel water slurry is used as upper furnace fuel. If no completion air is used and a great amount of upper furnace slurry is used, it is only necessary to assure that the lower furnace is sufficiently air rich to supply the oxygen for burn out.

Our fuel injection temperature window is much wider than reburn temperature windows where it is only economical to reburn with 2 to 12% of the total fuel. In our case, where the fuel water slurry is at most little more expensive than the base fuel, and often less expensive, we can use 25% of the fuel as upper furnace injection fuel and do so at high temperatures while achieving large $NO_x$ reductions. Many biowaste materials can be economically used. Orremulsion may also be cheaper than coal.

Our temperature window is 1700° to 2800° F. The slurry is from 20% to 80% water, and adjustments can be made to accommodate different furnaces or furnace conditions. The slurry is introduced both as streams (jet) and spray of drops, usually in combination to assure better coverage.

We do not require carrier air, steam, nor flue gas. We can design systems with and without burn out air. We do not require the elaborate duct work of other processes. We do not require the expensive natural gas.

Although we have described certain present preferred embodiments of our method and apparatus, it should be distinctly understood that our invention is not limited thereto, but may be variously embodied within the scope of the following claims.

We claim:

1. An in-furnace method of reducing nitrogen oxides in the flue gas comprising the step of injecting a fuel water supply comprising a slurry of water and a material selected from the group consisting of biowaste and biomass such that the material provides 0.4% to 2.0% nitrogen on a moisture free and ash free basis into said flue gas so that the material and water mix with nitrogen oxides in the furnace, the material being injected in sufficient quantity to promote a reaction between said nitrogen oxides in the flue gas and said material, so as to substantially reduce nitrogen oxide content of the flue gas and to maintain overall fuel lean conditions above the primary combustion zone.

2. The method in claim 1 wherein burnout air is injected with the slurry.

3. The method in claim 2 wherein the slurry fuel is introduced in sufficient quantity to render the overall gas stream fuel rich.

4. The method in claim 1 wherein the slurry is injected into flue gas having a temperature range of 1700° to 2800° F.

5. The method of claim 1 also comprising introducing combustion air at a location where the fuel water slurry is injected.

6. The method of claim 1 also comprising adding limestone to the fuel water slurry.

7. The method of claim 1 also comprising adding lime to the fuel water slurry.

8. The method of claim 1 also comprising changing a ratio of water to material in the fuel water slurry in order to trim the slurry burn temperature and chemistry.

9. The method of claim 1 also comprising adding a fixed reduced nitrogen to the slurry.

10. The method in claim 9 wherein the reduced nitrogen is as ammonia.

11. The method in claim 9 wherein the reduced nitrogen is as urea.

12. The method of claim 9 wherein the reduced nitrogen is supplied in animal waste.

13. The method of claim 9 wherein the reduced nitrogen is supplied in plant material.

14. The method of claim 9 also comprising changing a ratio of water to material to improve use of fixed nitrogen.

15. The method of claim 9 also comprising injecting a catalyst with the slurry to increase the reduction of $NO_x$ by the reduced fixed nitrogen available.

16. The method of claim 1 also comprising changing a ratio of water to material during injection of the slurry to trim an upper furnace combustion temperature and to adjust concentrations of reactants in the flue gas.

17. An in-furnace method of reducing nitrogen oxides in the flue gas comprising the step of injecting a fuel water supply comprising a slurry of (ii) water; (ii) a material selected from the group consisting of biowaste and biomass, and (iii) a fixed nitrogen source such that the material and the fixed nitrogen source together provide 0.4% to 2.0% nitrogen on a moisture free and ash free basis into said flue gas so that the material, fixed nitrogen source and water mix with nitrogen oxides in the furnace, the material and fixed nitrogen source being injected in sufficient quantity to promote a reaction between said nitrogen oxide in the flue gas and said material, and fixed nitrogen source so as to substantially reduce nitrogen oxide content of the flue gas and to maintain overall fuel lean conditions above the primary combustion zone.

18. The method in claim 17 wherein burnout air is injected with the slurry.

19. The method in claim 17 wherein the slurry fuel is introduced in sufficient quantity to render the overall gas stream fuel rich.

20. The method in claim 17 wherein the slurry is injected into flue gas having a temperature range of 1700° to 2800° F.

21. The method of claim 17 also comprising introducing combustion air at a location where the full water slurry is injected.

22. The method of claim 17 also comprising adding limestone to the fuel water slurry.

23. The method of claim 17 also comprising changing a ratio of water to material in the fuel water slurry in order to trim the slurry burn temperature and chemistry.

24. The method in claim 17 wherein the fixed nitrogen source is ammonia.

25. The method in claim 17 wherein the fixed nitrogen source is urea.

26. The method of claim 17 also comprising changing a ratio of water to material to improve use of fixed nitrogen.

27. The method of claim 17 also comprising injecting a catalyst with the slurry to increase the reduction of $NO_x$ by the reduced fixed nitrogen available.

28. The method of claim 17 also comprising changing a ratio of water to material during injection of the slurry to trim an upper furnace combustion temperature and to adjust concentrations of reactants in the flue gas.

* * * * *

UNITED STATES PATENT AND TRADEMARK OFFICE

CERTIFICATE OF CORRECTION

PATENT NO. : 6,357,367 B1 
DATED : March 19, 2002
INVENTOR(S) : Bernard P. Breen, Jeffrey J. Sweterlitsch and James E. Gabrielson It is certified that error appears in the above-identified patent and that said Letters Patent is hereby corrected as shown below:

Column 8,
Line 16, change "supply" to -- slurry --.
Line 65, change "supply" to -- slurry -- and change the first occurrence of "(ii)" to -- (i) --.

Column 9,
Line 20, change "full" to -- fuel --.

Signed and Sealed this

Twenty-eighth Day of May, 2002

*Attest:*

*Attesting Officer*

JAMES E. ROGAN
*Director of the United States Patent and Trademark Office*